US008844308B2

(12) United States Patent
Martin et al.

(10) Patent No.: US 8,844,308 B2
(45) Date of Patent: Sep. 30, 2014

(54) CASCADE REFRIGERATION SYSTEM WITH SECONDARY CHILLER LOOPS

(75) Inventors: Jon Scott Martin, Conyers, GA (US); Nicholas D. Shockley, Fayetteville, AR (US)

(73) Assignee: Hill Phoenix, Inc., Conyers, GA (US)

( * ) Notice: Subject to any disclaimer, the term of this patent is extended or adjusted under 35 U.S.C. 154(b) by 877 days.

(21) Appl. No.: 12/951,962

(22) Filed: Nov. 22, 2010

(65) Prior Publication Data

US 2011/0061419 A1 Mar. 17, 2011

Related U.S. Application Data

(63) Continuation of application No. 11/939,306, filed on Nov. 13, 2007, now abandoned.

(51) Int. Cl.

| | |
|---|---|
| ***F25B 7/00*** | (2006.01) |
| ***F25B 25/00*** | (2006.01) |
| ***F25D 17/02*** | (2006.01) |

(52) U.S. Cl.

CPC ..... *F25D 17/02* (2013.01); *F25B 2339/047* (2013.01); *F25B 7/00* (2013.01); *F25B 2400/06* (2013.01); *F25B 25/005* (2013.01)

USPC ..... 62/335

(58) Field of Classification Search

CPC ..... F25B 7/00; F25B 2400/06; F25B 25/005; F25B 2339/047; F25D 17/02

USPC ..... 62/335, 336

See application file for complete search history.

(56) References Cited

U.S. PATENT DOCUMENTS

| | | | |
|---|---|---|---|
| 2,680,956 | A | 6/1954 | Haas |
| 3,392,541 | A | 7/1968 | Nussbaum |
| 4,149,389 | A | 4/1979 | Hayes et al. |
| 4,194,368 | A | 3/1980 | Bahel et al. |
| 4,263,785 | A | 4/1981 | Barniak et al. |
| 4,313,309 | A | 2/1982 | Lehman, Jr. |

(Continued)

FOREIGN PATENT DOCUMENTS

| | | | |
|---|---|---|---|
| EP | 0340115 | * 11/1989 | ..... F25B 7/00 |
| EP | 0340115 A1 | 11/1989 | |

OTHER PUBLICATIONS

Machine translation of EP0340115 May 21, 2013.*

*Primary Examiner* — Cheryl J Tyler
*Assistant Examiner* — Ana Vazquez
(74) *Attorney, Agent, or Firm* — Foley & Lardner LLP

(57) ABSTRACT

A refrigeration system includes a first portion having a primary loop and a secondary loop operably coupled by a first chiller, The primary loop circulates a refrigerant through the first chiller to provide cooling to a coolant in the secondary loop. The secondary loop has a supply portion and a return portion, the supply portion circulates the coolant to one or more temperature-controlled storage devices operating at a first temperature. A second portion has a primary loop and at least one secondary loop operably coupled by the second chiller. The primary loop circulates a refrigerant through the second chiller to provide cooling to coolant in the secondary loop. The secondary loop has a supply portion and a return portion, the supply portion circulates the coolant to one or more temperature-controlled storage devices operating at a second temperature. The return portion of the secondary loop of the first portion and the return portion of the secondary loop of the second portion share a common return header.

13 Claims, 6 Drawing Sheets

(56) References Cited

U.S. PATENT DOCUMENTS

| | | | |
|---|---|---|---|
| 5,335,508 | A | 8/1994 | Tippmann |
| 5,440,894 | A | 8/1995 | Schaeffer et al. |
| 6,112,547 | A | 9/2000 | Spauschus et al. |
| 6,128,914 | A | 10/2000 | Tamaoki et al. |
| 6,131,401 | A | 10/2000 | Ueno et al. |
| 6,237,358 | B1 | 5/2001 | Kondo et al. |
| 6,260,377 | B1 | 7/2001 | Tamaoki et al. |
| 6,298,683 | B1 | 10/2001 | Kondo et al. |
| 6,324,856 | B1 | 12/2001 | Weng |
| 6,393,858 | B1 | 5/2002 | Mezaki et al. |
| 6,405,554 | B1 | 6/2002 | Kawakatu et al. |
| 7,913,506 | B2 | 3/2011 | Bittner et al. |
| 2004/0031280 | A1 | 2/2004 | Martin et al. |
| 2005/0120737 | A1 | 6/2005 | Borror et al. |
| 2009/0025404 | A1 | 1/2009 | Allen |
| 2010/0023171 | A1 | 1/2010 | Bittner et al. |
| 2010/0031697 | A1 | 2/2010 | Hinde et al. |

* cited by examiner

CASCADE REFRIGERATION SYSTEM WITH SECONDARY CHILLER LOOPS

CROSS REFERENCE TO RELATED APPLICATIONS

The present Application claims the benefit of priority as a continuation of U.S. patent application Ser. No. 11/939,306 titled "Refrigeration System" filed on Nov. 13, 2007, the complete disclosure of which is hereby incorporated by reference in its entirety.

FIELD

The present inventions relate to a refrigeration system. The present inventions relate more particularly to a refrigeration system having improved thermal characteristics for use with refrigerated display cases having various temperature storage requirements.

BACKGROUND

It is well known to provide a refrigeration system for use with one or more temperature controlled storage devices such as a refrigerator, freezer, refrigerated merchandiser, display case, etc. that may be used in commercial, institutional, and residential applications for storing or displaying refrigerated or frozen objects. For example, it is known to provide a refrigeration system having a refrigerant for direct expansion in a single loop operation to provide cooling to heat exchanger such as an evaporator or chiller. It is also known to provide a secondary liquid coolant loop that is cooled by the chiller and then routed to various storage devices to provide cooling to temperature controlled objects. It is also known to provide temperature controlled storage devices operating at various temperatures. A refrigeration system having improved efficiency and thermal characteristics for use with temperature controlled storage devices operating at various temperatures is provided.

SUMMARY

The present invention also relates to a refrigeration system that includes a low temperature portion having a primary loop and a secondary loop operably coupled by a chiller. The primary loop circulates refrigerant through the chiller to provide cooling to a coolant in the secondary loop. The secondary loop has a supply portion and a return portion. The supply portion circulates the coolant to temperature-controlled storage devices operating at a low temperature. The refrigeration system also includes a medium temperature portion having a primary loop and at least one secondary loop operably coupled by at least one chiller. The primary loop circulates a refrigerant through the chiller to provide cooling to coolant in the secondary loop. The secondary loop has a supply portion and a return portion, where the supply portion circulates the coolant to temperature-controlled storage devices operating at a medium temperature. The return portion of the secondary loop of the low temperature portion and the return portion of the secondary loop of the medium temperature portion share a common return header.

The present invention also relates to a refrigeration system that includes a low temperature portion with a primary loop and a secondary loop operably coupled by a chiller. The primary loop circulates a refrigerant through the chiller to provide cooling to a coolant in the secondary loop. The secondary loop has a supply portion and a return portion. The supply portion circulates the coolant to temperature-controlled storage devices operating at a low temperature. The refrigeration system also includes a medium temperature portion with at least one modular unit containing a primary loop and a chiller. The medium temperature portion also includes at least one secondary loop operably coupled to the chiller. The primary loop circulates a refrigerant through the chiller to provide cooling to coolant in the secondary loop. The secondary loop has a supply portion and a return portion, where the supply portion circulates the coolant to temperature-controlled storage devices operating at a medium temperature, and the return portion of the secondary loop of the low temperature portion and the return portion of the secondary loop of the medium temperature portion share a common return header.

The present invention also relates to a refrigeration system having a primary loop and a secondary loop operably coupled by a chiller. The primary loop circulates a refrigerant through the chiller to provide a chilled coolant supply in the secondary loop. The secondary loop has a first flow path and a second flow path. The first flow path circulates a first portion of the chilled coolant supply to temperature-controlled storage devices operating at a low temperature and to return unchilled coolant to the chiller. The second flow path combines a portion of the chilled coolant supply with a portion of the unchilled coolant for delivery as a combined liquid coolant to temperature-controlled storage devices operating at a medium temperature.

DETAILED DESCRIPTION

Referring to the FIGURES, a refrigeration system is shown for use with a plurality of temperature controlled storage devices, where the storage devices may have different storage temperature requirements (e.g. "low temperature," such as approximately −20° F., and "medium temperature," such as approximately 25° F.). However, the various temperatures of the storage devices, refrigerants and liquid coolants illustrated or described in the various embodiments, are shown by way of example only. A wide variety of other temperatures and temperature ranges may be used to suit any particular application and are intended to be within the scope of this disclosure. Also, the various flow rates, capacity and balancing of coolants and refrigerants are described by way of example and may be modified to suit a wide variety of applications depending on the number of storage devices, the temperature requirements of the storage devices, etc.

Figure 1:
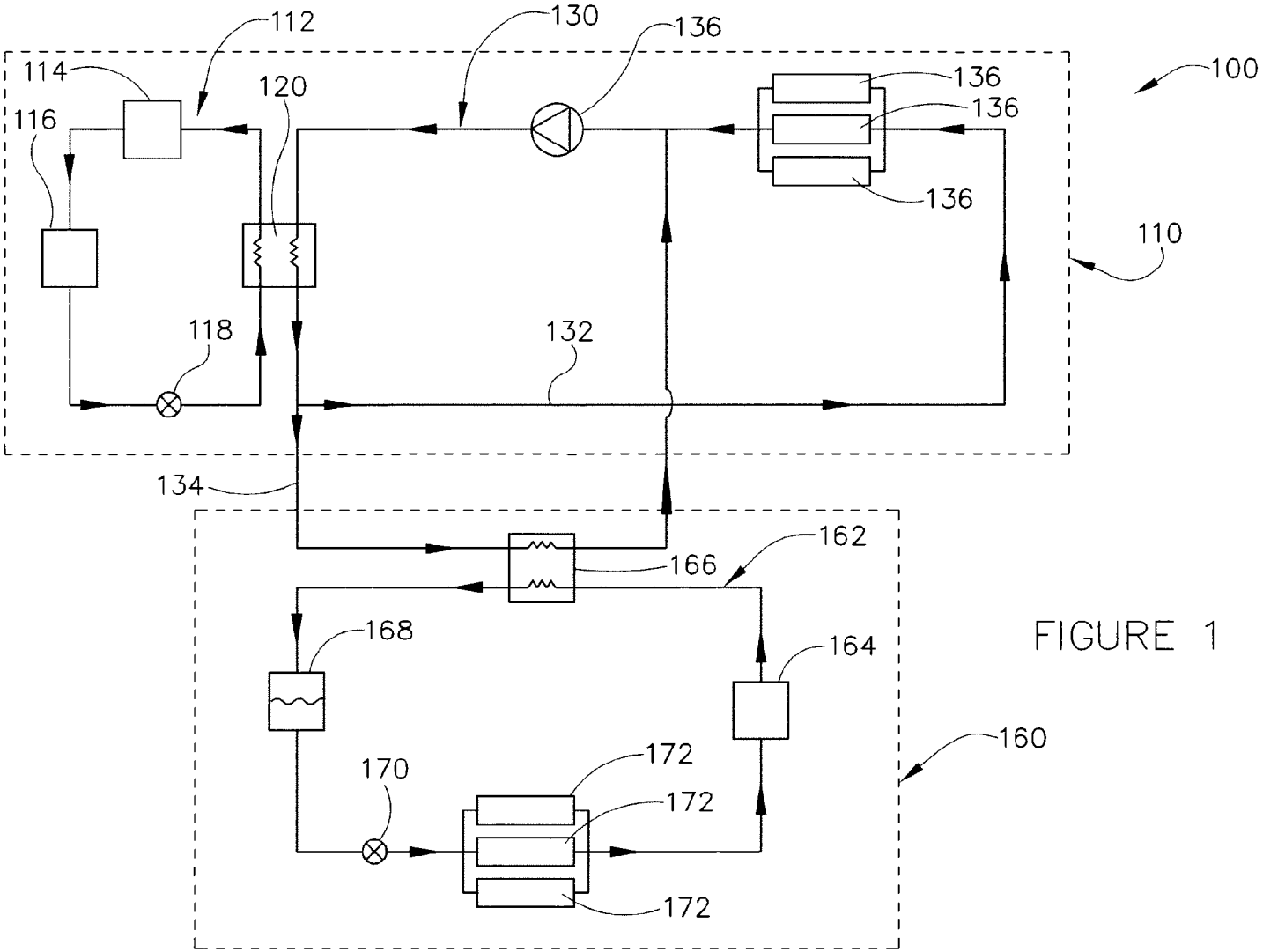
FIG. 1 is a schematic diagram of a refrigeration system having a liquid coolant supplied to medium temperature storage devices and for cooling a condenser associated with low temperature storage devices, according to an exemplary embodiment.

Referring to FIG. 1, a refrigeration system 100 includes a first portion shown as a medium temperature portion 110 for use with temperature controlled storage devices having a "medium" storage temperature requirement (such as, for example, 25° F. and referred to herein as medium temperature storage devices), and a low temperature portion 160 for use with temperature controlled storage devices having a "low" storage temperature requirement (such as, for example, −20° F. and referred to herein as low temperature storage devices), according to an exemplary embodiment.

The low temperature portion 160 is shown to include a cooling loop 162 (e.g. formed from suitable conduits or passageways such as pipes, fittings, tubing, etc.) having a refrigerant (e.g. a direct expansion type refrigerant such as R-404A, or carbon dioxide or other suitable refrigerant) as a cooling medium. The refrigerant is compressed by a compressor 164 to a high temperature and high pressure state, and is then cooled in a condenser 166, and then expanded by an expansion device (such as an expansion valve 170) to provide a source of cooling to a heat exchanger operating as a cooling element (such as a cooling coil, evaporator, etc.) in one or more low temperature storage devices (shown for example as three low temperature storage devices 172). According to the illustrated embodiment, the low temperature portion is shown to include a receiver 168. According to alternative embodiments, a receiver may be omitted. According to other alternative embodiments, other components or equipment such as a sub-cooler, liquid line or suction line filter, oil management system, etc. may be included in the system.

The medium temperature portion 110 is shown to include a first (or primary) cooling loop 112 (e.g. formed from suitable conduits or passageways such as pipes, fittings, tubing, etc.) having a refrigerant (e.g. a direct expansion type refrigerant such as R404A) as a cooling medium. The refrigerant is compressed by a compressor 114 to a high temperature and high pressure state, and is then cooled in a condenser 116, then expanded in an expansion device (such as an expansion valve 118) to provide a source of cooling to a heat exchanger (shown as a chiller 120). According to one embodiment, the components of first cooling loop 112 operate to provide refrigerant at a temperature of approximately 13° F. to the chiller.

The medium temperature portion 110 also includes a second (or secondary) cooling loop 130 having a first portion 132 and a second portion 134 (e.g. circuits, branches, flow paths, etc.—formed from suitable conduits or passageways such as pipes, fittings, tubing, etc.) for circulation of a liquid coolant (such as water, glycol, etc.) as a cooling medium by a pump 136. According to one embodiment, the second cooling loop 130 is cooled by the refrigerant in chiller 120 to a temperature of approximately 20° F. The liquid coolant is circulated through the first portion 132 to provide cooling to a heat exchanger within one or more medium temperature storage devices (shown for example as three medium temperature storage devices 136). The liquid coolant is also circulated through the second portion 134 to provide cooling to condenser 166 of the low temperature portion of the system.

One of the advantages of the exemplary embodiment illustrated in FIG. 1 is that cooling for the condenser 166 of the low temperature portion 160 of the system 100 may be provided by the liquid coolant of the medium temperature portion 110 of the system 100, thereby eliminating the need for a separate cooling system (e.g. a separate water-filled cooling loop routed to a remote heat exchanger) for cooling the condenser 166. Another advantage is to provide energy efficient, low temperature condensing to low temperature portion 160 of the system.

Figure 2:
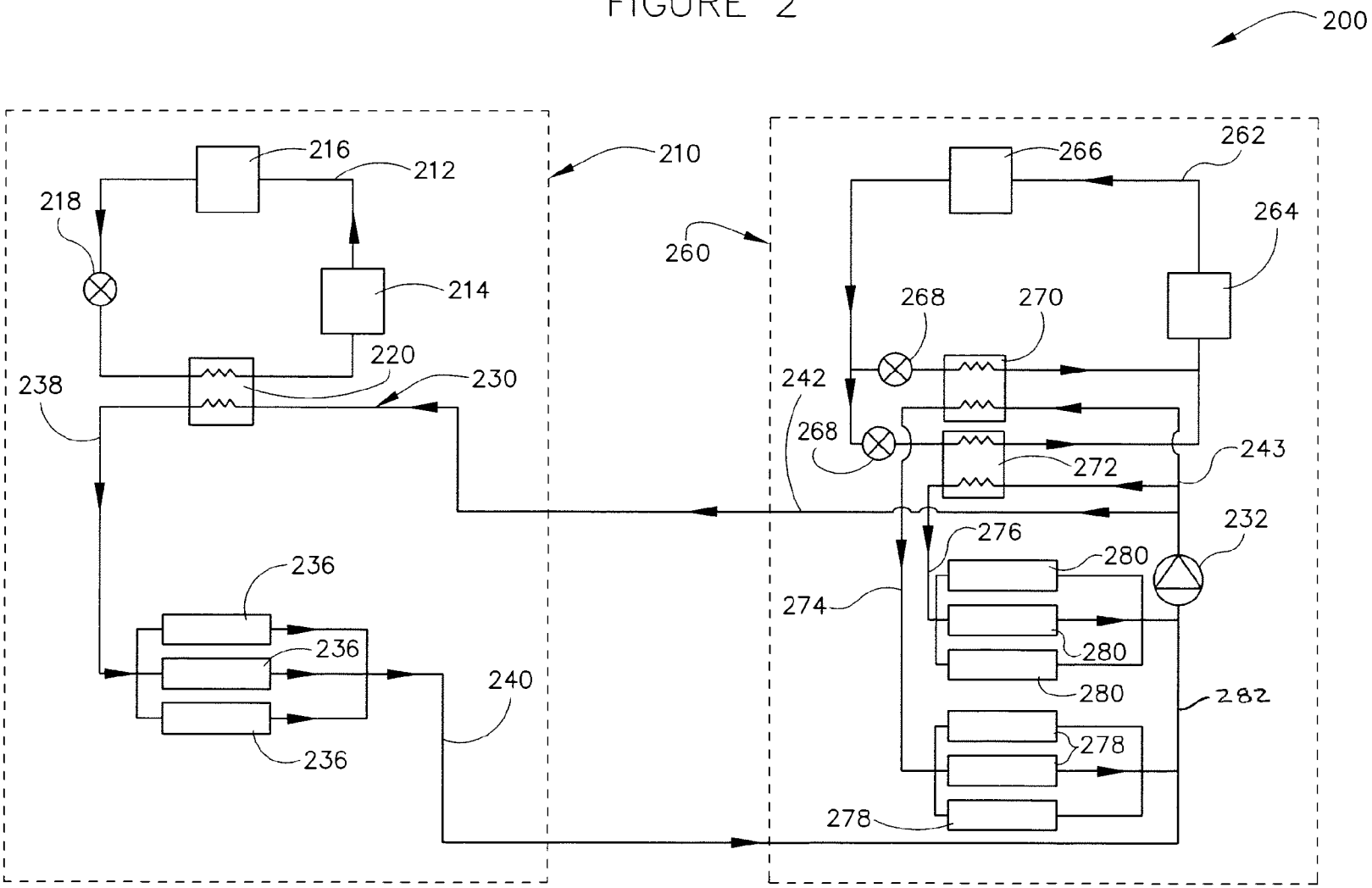
FIG. 2 is a schematic diagram of a refrigeration system for low and medium temperature storage devices having a common return header for a liquid coolant, according to an exemplary embodiment.

Referring to FIG. 2, a refrigeration system 200 for low and medium temperature storage devices having a common return header for a liquid coolant, is shown according to another exemplary embodiment. Refrigeration system 200 includes a first portion shown as a low temperature portion 210 for use with low temperature storage devices, and a medium temperature portion 260 for use with medium temperature storage devices.

The low temperature portion 210 is shown to include a first (or primary) cooling loop 212 (e.g. formed from suitable conduits or passageways such as pipes, fittings, tubing, etc.) having a refrigerant (e.g. a direct expansion type refrigerant) as a cooling medium. The refrigerant is compressed by a compressor 214 to a high temperature and high pressure state, and is then cooled in a condenser 216, then expanded by an expansion device (such as an expansion valve 218) to provide a source of cooling to a heat exchanger (shown as a chiller 220). According to one embodiment, the components of first cooling loop 212 operate to provide refrigerant at a temperature of approximately 13° F. to the chiller 220.

Low temperature portion 210 also includes a second (or secondary) cooling loop 230 (e.g. formed from suitable conduits or passageways such as pipes, fittings, tubing, etc.) for circulation of a liquid coolant as a cooling medium by a pump 232. According to one embodiment, the liquid coolant in the second cooling loop 230 is cooled by the refrigerant in chiller 220 to a temperature of approximately 20° F. and is circulated to provide cooling to a heat exchanger within one or more low temperature storage devices (shown for example as three low temperature storage devices 236). The secondary cooling loop includes a supply portion 238 (i.e. the portion between the chiller 220 and the storage devices 236 and "upstream" of the storage devices 236, and a return portion 240 (i.e. the portion between the storage devices 236 and the pump 232 and "downstream" from low temperature storage devices 236) and the liquid coolant returns to chiller 220 with a temperature of approximately 30° F.

The medium temperature portion 260 of the system 200 is shown to include a first (or primary) cooling loop 262 (e.g. formed from suitable conduits or passageways such as pipes, tubing, etc.) having a refrigerant as a cooling medium to provide cooling to one or more chillers. The refrigerant is compressed by a compressor 264 to a high temperature and high pressure state, and is then cooled in a condenser 266, then expanded in an expansion device (shown as expansion valves 268) to provide a source of cooling to heat exchangers (shown for example as two chillers 270, 272). According to one embodiment, the components of first cooling loop 262 operate to provide refrigerant at a temperature of approximately 18° F. to the chillers.

The medium temperature portion 260 also includes a second (or secondary) cooling loop 274, 276 associated with each of chillers 270, 272 (e.g. formed from suitable conduits or passageways such as pipes, fittings, tubing, etc.) for circulation of a liquid coolant as a cooling medium by pump 232. Although the medium temperature portion 260 of the system 200 is shown to have two chillers for use in cooling two groups of storage devices, any number of chillers may be used to provide cooling to any number of groups of storage devices. According to one embodiment, the secondary cooling loops 274, 276 are cooled by the refrigerant in chillers 270, 272 to a temperature of approximately 25° F. and the liquid coolant returns to chillers 270, 272 with a temperature of approximately 30° F. Secondary cooling loop 274 is associated with chiller 270 to provide cooling to a heat exchanger within one or more medium temperature storage devices from a first group (shown for example as three medium temperature storage devices 278) and secondary cooling loop 276 is associated with chiller 272 to provide cooling to a heat exchanger within one or more medium temperature storage devices from a second group (shown for example as three medium temperature storage devices 280). Secondary loops 274, 276 each have a return portion that share a common flow path (e.g. manifold, etc. and shown as a header 282) with one another, and with the return portion 240 of the secondary loop 230 for the low temperature portion 210. The return portions for the low and medium temperature portions of the system then diverge into separate branches 242, 243 to complete their respective loops and return the liquid coolant to their respective chillers.

One of the advantages of the exemplary embodiment illustrated in FIG. 2 is that liquid coolant returned from the low temperature storage devices 236 may be used to pre-cool the returned liquid coolant in the medium temperature loops 274, 276 prior to entering the medium temperature chillers 270, 272. According to the illustrated embodiment, the liquid coolant return 242 from the header 282 to the low temperature portion 210 of the system 200 branches from the header 282 downstream of the medium temperature storage devices 278, 280, but upstream of the medium temperature chillers 270, 272. Another advantage is the ability to allow multiple temperature fluid portions of the system to share a common pump station Referring to FIG. 3, a refrigeration system 300 for low and medium temperature storage devices having a common return header for a liquid coolant and pre-cooling for the liquid coolant returned from the low temperature storage devices, is shown according to another exemplary embodiment. Refrigeration system 300 includes a first portion shown as a low temperature portion 310 for use with low temperature storage devices, and a second portion shown as a medium temperature portion 360 for use with medium temperature storage devices.

The low temperature portion 310 is shown to include a first (or primary) cooling loop 312 having a refrigerant as a cooling medium. The refrigerant is compressed by a compressor 314 to a high temperature and high pressure state, and is then cooled in a condenser 316, then expanded by an expansion device (such as an expansion valve 318) to provide a source of cooling to a heat exchanger (shown as a chiller 320). According to one embodiment, the components of first cooling loop 312 operate to provide refrigerant at a temperature of approximately 13° F. to the chiller 320.

Low temperature portion 310 also includes a second (or secondary) cooling loop 330 for circulation of a liquid coolant as a cooling medium by a pump 332. According to one embodiment, the liquid coolant in the second cooling loop 330 is cooled by the refrigerant in chiller 320 to a temperature of approximately 20° F. and is circulated to provide cooling to a heat exchanger within one or more low temperature storage devices (shown for example as three low temperature storage devices 336). The secondary cooling loop includes a supply portion 338 and a return portion 340.

The medium temperature portion 360 of the system 300 is shown to include a first (or primary) cooling loop 362 having a refrigerant as a cooling medium to provide cooling to one or more chillers. The refrigerant is compressed by a compressor 364 to a high temperature and high pressure state, and is then cooled in a condenser 366, then expanded in an expansion device (shown as expansion valves 368) to provide a source of cooling to the heat exchangers (shown for example as two chillers 370, 372). According to one embodiment, the components of first cooling loop 362 operate to provide refrigerant at a temperature of approximately 18° F. to the chillers 370, 372.

The medium temperature portion 360 also includes a second (or secondary) cooling loop 374, 376 associated with each of chillers 370, 372 for circulation of a liquid coolant by pump 332. Although the medium temperature portion 360 of the system 300 is shown to have two chillers for use in cooling two groups of storage devices, any number of chillers may be used to provide cooling to any number of groups of storage devices. According to one embodiment, the secondary cooling loops 374, 376 are cooled by the refrigerant in chillers 370, 372 to a temperature of approximately 25° F. and the liquid coolant returns to chillers 370, 372 with a temperature of approximately 30° F. Secondary cooling loop 374 is associated with chiller 370 to provide cooling to a heat exchanger within one or more medium temperature storage devices 378 from a first group, and secondary cooling loop 376 is associated with chiller 372 to provide cooling to a heat exchanger within one or more medium temperature storage devices 380 from a second group. Secondary loops 374, 376 each have a return portion that share a common header 382 with one another, and with the return portion 340 of the secondary loop 330 for the low temperature portion 310. According to an alternative embodiment, the secondary cooling loops may also share a common supply header.

According to the illustrated embodiment, the return portion 340 of the secondary loop 330 for the low temperature portion 310 is routed through one or both of chillers 370, 372 (shown for example as both chillers 370, 372) to pre-cool the liquid coolant before entering the chiller 320 of the low temperature portion 310. The return portion 340 for the low temperature portion 310 of the system 300 then diverges from the supply side of one or both medium temperature secondary cooling loops 374, 376 (shown for example as both cooling loops) into a separate branch 342 to complete its return loop to provide the liquid coolant to the chiller 320 of the low temperature portion 310 of the system 300. According to the exemplary embodiment, the liquid coolant supplied to the medium temperature storage devices 378, 380 and the liquid coolant returned to the chiller 320 of the low temperature portion 310 of the system 300 is approximately 25° F.

Figure 3:
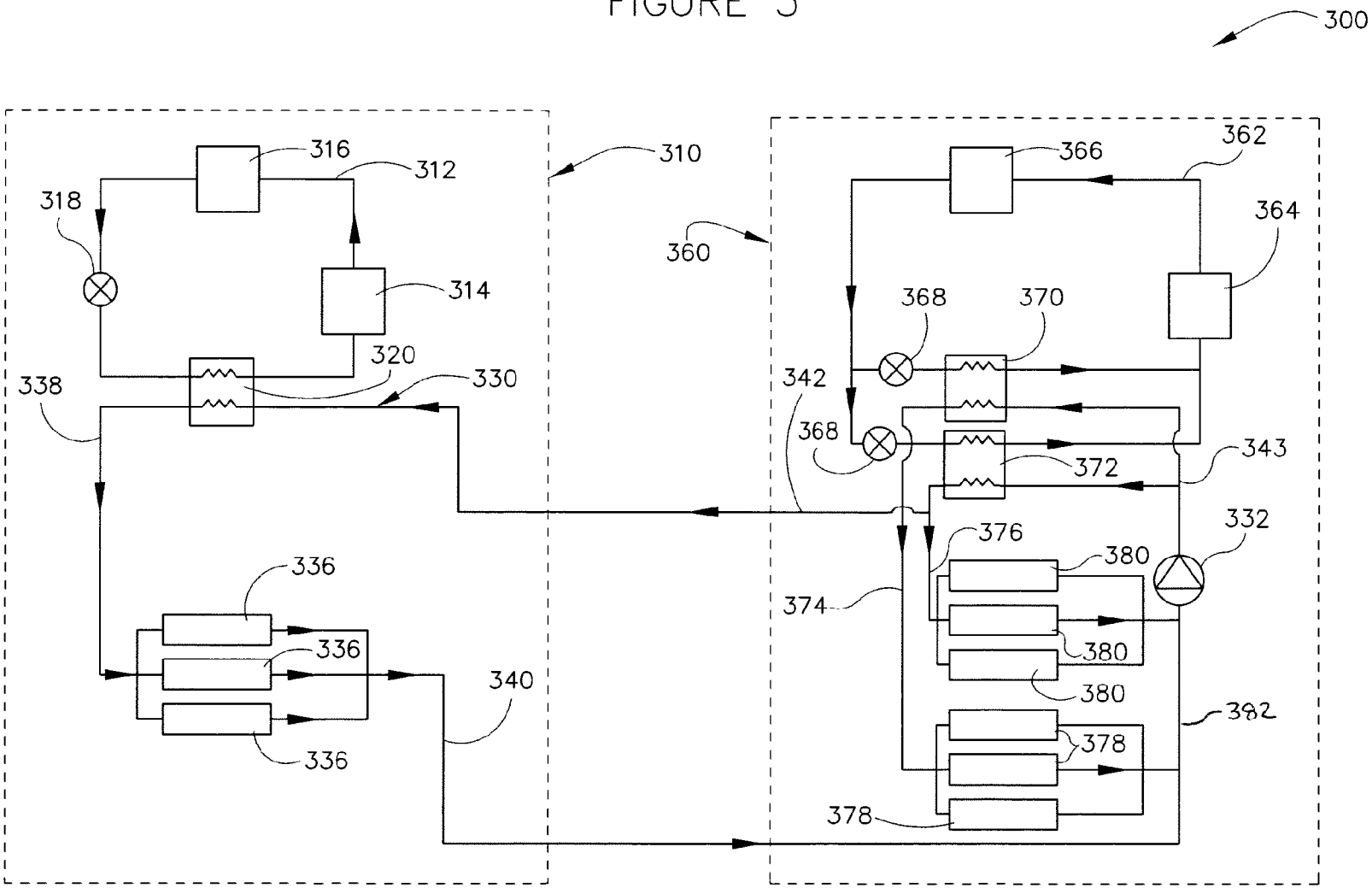
FIG. 3 is a schematic diagram of a refrigeration system for low and medium temperature storage devices having a common return header and pre-cooling for liquid coolant used with the low temperature storage devices, according to an exemplary embodiment.

One of the advantages of the exemplary embodiment illustrated in FIG. 3 is that chiller(s) from the medium temperature system 360 may be used to pre-cool the liquid coolant returned from the low temperature storage device(s) 336 prior to entering the low temperature chiller 320.

Figure 4:
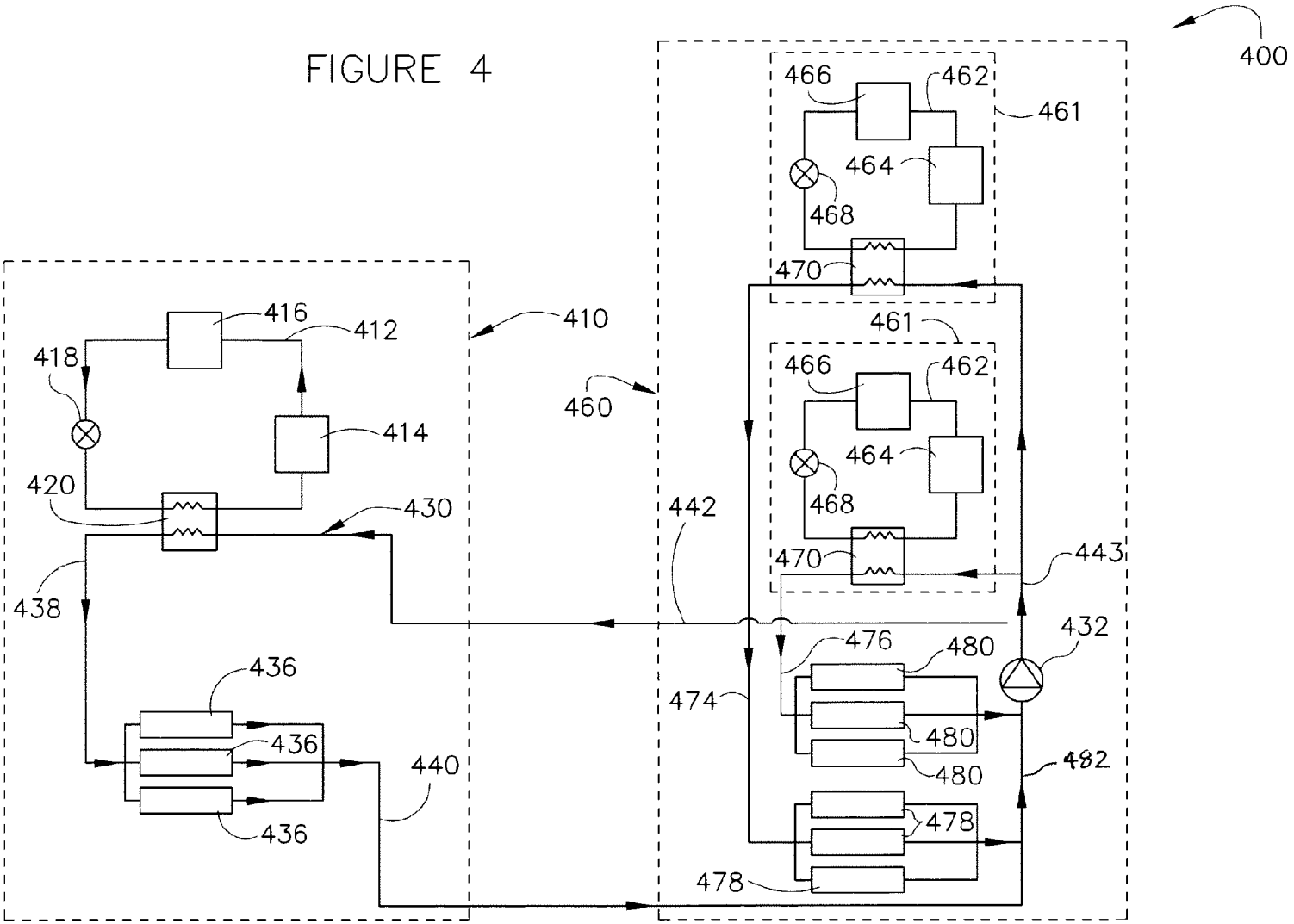
FIG. 4 is a schematic diagram of the refrigeration system of FIG. 2 and including modular condensing units for the medium temperature storage devices, according to an exemplary embodiment.

Referring to FIG. 4, a refrigeration system 400 for low and medium temperature storage devices having a common return header for a liquid coolant, and modular condensing units to provide cooling to each of the groups of medium temperature storage devices, is shown according to another exemplary embodiment. Refrigeration system 400 includes a first portion shown as a low temperature portion 410 for use with low temperature storage devices, and a medium temperature portion 460 for use with medium temperature storage devices.

The low temperature portion 410 is shown to include a first (or primary) cooling loop 412 having a refrigerant as a cooling medium. The refrigerant is compressed by a compressor 414 to a high temperature and high pressure state, and is then cooled in a condenser 416, then expanded by an expansion device (such as an expansion valve 418) to provide a source of cooling to a heat exchanger (shown as a chiller 420). According to one embodiment, the components of first cooling loop 412 operate to provide refrigerant at a temperature of approximately 13° F. to the chiller 420.

Low temperature portion 410 also includes a second (or secondary) cooling loop 430 for circulation of a liquid coolant by a pump 432. According to one embodiment, the liquid coolant in the second cooling loop 430 is cooled by the refrigerant in chiller 420 to a temperature of approximately 20° F. and is circulated to provide cooling to a heat exchanger within one or more low temperature storage devices (shown for example as three low temperature storage devices 436). The secondary cooling loop includes a supply portion 438, and a return portion 440 and the liquid coolant returns to chiller 420 with a temperature of approximately 30° F.

The medium temperature portion 460 of the system 400 shown to include one or more modular, independent, and self-contained condensing units (e.g. packages, modules, etc.—shown for example as two modular condensing units 461 associated with each group of medium temperature storage devices. Each modular condensing unit includes a first (or primary) cooling loop 462 formed from suitable conduits or passageways such as pipes, fittings, tubing, etc.) having a refrigerant as a cooling medium to provide cooling to one or more chillers. The refrigerant is compressed by a compressor 464 to a high temperature and high pressure state, and is then cooled in a condenser 466, then expanded in an expansion device (shown as expansion valves 468) to provide a source of cooling to a heat exchanger (shown for example as a chiller 470). According to one embodiment, the components of each modular condensing unit 461 operate to provide refrigerant at a temperature of approximately 18° F. to the chillers 470. According to alternative embodiments, the modular condensing units may be configured to operate at different temperatures for use with groups of temperature controlled storage devices designed to operate at different temperatures. Further, any number of modular condensing units may be provided for use in connection with corresponding groups of temperature controlled storage devices.

The medium temperature portion 460 also includes a second (or secondary) cooling loop 474, 476 associated with each of chillers 470 of the modular condensing units 461 for circulation of a liquid coolant by pump 432. According to one embodiment where the modular condensing units are operating at approximately the same temperature, the secondary cooling loops 474, 476 are cooled by the refrigerant in chillers 470 to a temperature of approximately 25° F. and the liquid coolant returns to chillers 470 with a temperature of approximately 30° F. Secondary loops 474, 476 each have a return portion that share a common flow path (e.g. manifold, etc.—shown as a return header 482) with one another, and with the return portion 440 of the secondary loop 430 for the low temperature portion 410. The return portions for the low and medium temperature portions of the system then diverge into separate branches 442, 443 to complete their respective loops and return the liquid coolant to their respective chillers. Secondary loops 474, 476 are shown to have separate supply portions, however the supply portions may be configured as a common supply header and the modular condensing units may be readily attachable and detachable (e.g. by suitable fittings, such as quick-connect devices, etc.) with the common supply and return headers (e.g. in a "plug and play" type manner, etc.) to facilitate maintenance, or for increasing or decreasing capacity, etc.

One of the advantages of the exemplary embodiment illustrated in FIG. 4 is that liquid coolant returned from the low temperature storage devices 436 may be used to pre-cool the returned liquid coolant in the medium temperature return header 482 prior to entering the chillers 470 of the modular condensing units 461. In addition, the benefits of the common return header may be combined with the advantages of the modularity of the primary cooling loops.

Figure 5:
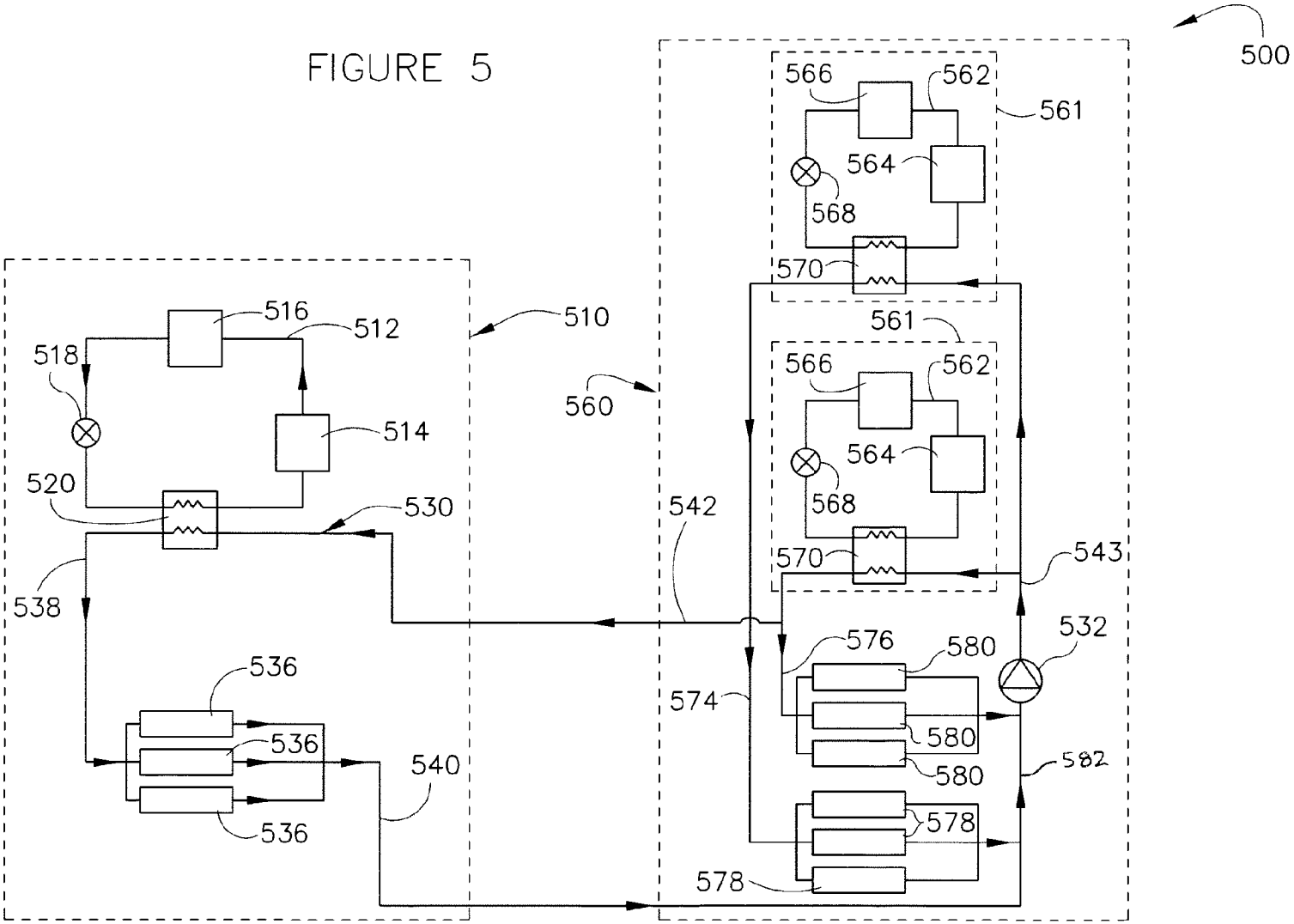
FIG. 5 is a schematic diagram of the refrigeration system of FIG. 3 and including modular condensing units for the medium temperature storage devices, according to an exemplary embodiment.

Referring to FIG. 5, a refrigeration system 500 for low and medium temperature storage devices having a common return header for a liquid coolant, and pre-cooling for the liquid coolant returned from the low temperature storage devices, and modular condensing units to provide cooling to each of the groups of medium temperature storage devices, is shown according to another exemplary embodiment. Refrigeration system 500 includes a first portion shown as a low temperature portion 510 for use with low temperature storage devices, and a second portion shown as a medium temperature portion 560 for use with medium temperature storage devices.

The low temperature portion 510 is shown to include a first (or primary) cooling loop 512 having a refrigerant as a cooling medium. The refrigerant is compressed by a compressor 514 to a high temperature and high pressure state, and is then cooled in a condenser 516, then expanded by an expansion device (such as an expansion valve 518) to provide a source of cooling to a heat exchanger (shown as a chiller 520). According to one embodiment, the components of first cooling loop 512 operate to provide refrigerant at a temperature of approximately 13° F. to the chiller 520.

Low temperature portion 510 also includes a second (or secondary) cooling loop 530 for circulation of a liquid coolant as a cooling medium by a pump 532. According to one embodiment, the liquid coolant in the second cooling loop 530 is cooled by the refrigerant in chiller 520 to a temperature of approximately 20° F. and is circulated to provide cooling to a heat exchanger within one or more low temperature storage devices (shown for example as three low temperature storage devices 536). The secondary cooling loop includes a supply portion 538 and a return portion 540.

The medium temperature portion 560 of the system 500 is shown to include one or more modular condensing units (shown for example as two modular condensing units 561) associated with each group of medium temperature storage devices. Each modular condensing unit includes a first (or primary) cooling loop 562 having a refrigerant to provide cooling to a chiller. The refrigerant is compressed by a compressor 564 to a high temperature and high pressure state, and is then cooled in a condenser 566, then expanded in an expansion device (shown as expansion valves 568) to provide a source of cooling to heat a exchanger (shown for example as chiller 570). According to one embodiment, the components of each modular condensing unit 561 operate to provide refrigerant at a temperature of approximately 18° F. to the chillers. According to alternative embodiments, the modular condensing units may operate at different temperatures for providing a desired temperature to their respective groups of temperature controlled storage devices.

The medium temperature portion 560 also includes a second (or secondary) cooling loop 574, 576 associated with each of chillers 570 of the modular condensing units for circulation of a liquid coolant by pump 532. According to one embodiment where the modular condensing units are operated at approximately the same temperature, the secondary cooling loops 574, 576 are cooled by the refrigerant in chillers 570 to a temperature of approximately 25° F. and the liquid coolant returns to chillers 570 with a temperature of approximately 30° F. Secondary loops 574, 576 each have a return portion that share a common flow path (e.g. return header 582) with one another, and with the return portion 540 of the secondary loop 530 for low temperature portion 510. Secondary loops 574, 576 are shown to have separate supply portions, however the supply portions may be configured as a common header and the modular condensing units may be readily attachable and detachable as previously described.

According to the illustrated embodiment, the return portion 540 of the secondary loop 530 for the low temperature portion 510 is routed through one or both of chillers 570 (shown for example as both chillers 570) of modular condensing units 561 to pre-cool the liquid coolant before entering the chiller 520 of the low temperature portion 510. The return portion for the low temperature portion 510 of the system 500 then diverges from the supply side of one or both medium temperature secondary cooling loops 574, 576 (shown for example as both cooling loops 574, 576) into a separate branch 542 to complete its return loop 540 to provide the liquid coolant to the chiller 520 of the low temperature portion 510 of the system 500. According to the exemplary embodiment, the liquid coolant supplied to the medium temperature storage devices 578, 580 and the liquid coolant returned to the chiller 520 of the low temperature portion 510 of the system 500 is approximately 25° F.

One of the advantages of the exemplary embodiment illustrated in FIG. 5 is that one or more chillers from the modular condensing units of the medium temperature system may be used to pre-cool the returned liquid coolant from the low temperature storage device prior to returning to the low temperature chiller. In addition, the benefits of the common return header and pre-cooling of the low temperature liquid coolant return may be combined with the advantages of the modularity of the medium temperature primary cooling loops.

Figure 6:
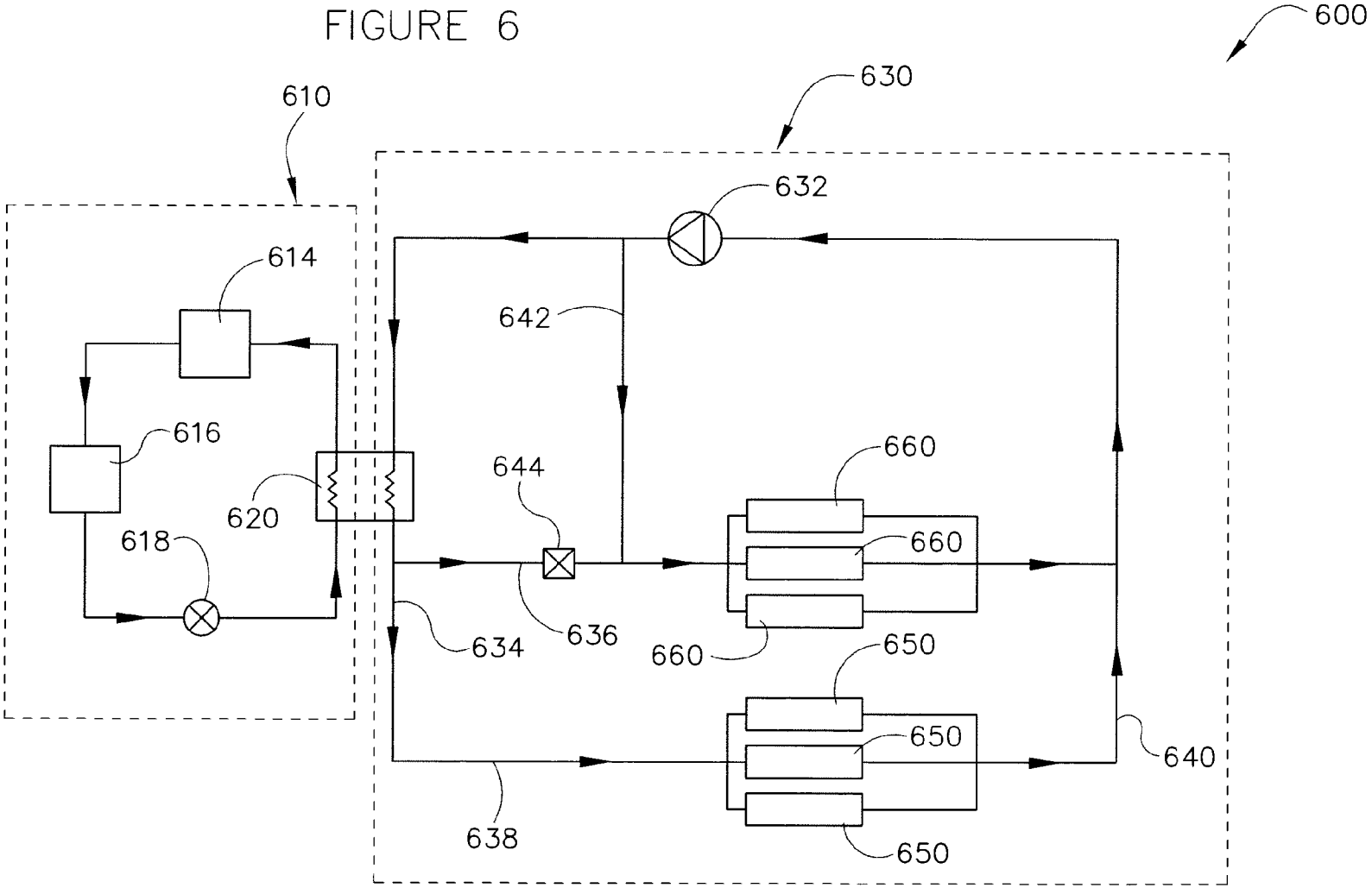
FIG. 6 is a schematic diagram of a refrigeration system for low and medium temperature storage devices that uses a liquid coolant supply to the low temperature storage devices to temper a coolant supply to the medium temperature storage devices, according to an exemplary embodiment.

Referring to FIG. 6, a refrigeration system 600 includes a first (or primary) cooling loop 610 having a refrigerant as a cooling medium. The refrigerant is compressed by a compressor 614 to a high temperature and high pressure state, and is then cooled in a condenser 616, then expanded in an expansion device (such as an expansion valve 618) to provide a source of cooling to a heat exchanger (shown as a chiller 620). According to one embodiment, the components of first cooling loop 610 operate to provide refrigerant at a temperature of approximately 13° F. to the chiller 620.

Refrigeration system 600 also includes a second (or secondary) cooling loop 630 having a first flow path 634 and a second flow path 636 (e.g. formed from suitable conduits or passageways such as pipes, fittings, tubing, etc.) for circulation of a liquid coolant as a cooling medium by a pump 632. According to one embodiment, the liquid coolant in the second cooling loop 630 is cooled by the refrigerant in chiller 620 to a temperature of approximately 20° F. to provide a chilled liquid coolant supply. A first portion of the chilled liquid coolant supply is directed into a supply portion 638 of the first flow path 634 to provide cooling to a heat exchanger within low temperature storage devices 650, and then as un-chilled liquid coolant through a return portion 640 back to chiller 620. A portion of the (un-chilled) liquid coolant returned from the low temperature storage devices 650 is also directed into (i.e. mixed with) a second portion of the chilled liquid coolant supply in the second flow path 636 via branch line 642 to deliver a supply of coolant to medium temperature storage devices 660. The second portion of the chilled liquid coolant supply is directed into the second flow path 636 which includes a tempering valve 644 to regulate the temperature of the combined liquid coolant supply (e.g. by modulating the position of valve 644 to control the mixing of the chilled coolant and the un-chilled coolant) to the medium temperature storage devices 660. For example, according to one embodiment, the temperature of the liquid coolant supplied to the first and second flow paths is approximately 20° F., and the temperature of the coolant returned from the low temperature storage devices and routed to the second flow path is approximately 28° F., and the tempering valve 644 operates to permit passage of sufficient liquid coolant supply to reduce the combined liquid coolant temperature from approximately 28° F. to approximately 25° F. for supply to the medium temperature storage devices 660.

One of the advantages of the exemplary embodiment illustrated in FIG. 6 is that a single primary loop and chiller may be used to provide cooling to storage devices having both low and medium temperature requirements.

According to any exemplary embodiment, the refrigeration system may also include suitable control and regulation components and equipment, such as valves (e.g. solenoid valves, manual and electronic balancing valves, pressure regulation valves, flow regulation valves, superheat control valves, etc.), temperature and pressure monitoring devices (e.g. thermocouples, resistance temperature detectors (RTDs), gauges, transducers, transmitters, sensors, etc.) operable to monitor a condition of the refrigerant, coolant or air space in the control devices and to send a signal representative of temperature and/or pressure to a control device of the system. The system may also include suitable control equipment (e.g. controllers) such as programmable logic controllers, microprocessors, etc. operable to receive the temperature and pressure signals and to operate the valves and other equipment (e.g. compressors, etc.) according to a predetermined control scheme to operate the system in a suitable manner to maintain a desired temperature within the temperature controlled storage devices. The control system may be provided locally (e.g. proximate other equipment of the system), or the control device may be provided at a remote location for controlling the operation of the system and/or other systems that may be in use at a facility. The control system may also be configured to control other operational requirements of the system, such as defrosting of the cooling elements within the temperature controlled storage devices (e.g. by temporarily interrupting the flow of coolant in a "time-off" manner, or initiating operation of electrical defrost elements, or by directing the flow of a warm fluid (e.g. hot refrigerant gas, heated liquid coolant, etc.) through the cooling elements, etc.).

It is important to note that the construction and arrangement of the elements and embodiments of the refrigeration system provided herein are illustrative only. Although only a few exemplary embodiments of the present invention have been described in detail in this disclosure, those skilled in the art who review this disclosure will readily appreciate that many modifications are possible in these embodiments (such as variations in features such as components, coolant compositions, heat sources, orientation and configuration of storage devices, location of components and sensors of the cooling and control systems; variations in sizes, structures, shapes, dimensions and proportions of the components of the system, use of materials, colors, combinations of shapes, etc.) without materially departing from the novel teachings and advantages of the invention. For example, closed or open space refrigeration systems may be used having either horizontal or vertical access openings, and cooling elements may be provided in any number, size, orientation and arrangement to suit a particular refrigeration system. According to other alternative embodiments, the refrigeration system may be used with any device using a refrigerant or coolant for transferring heat from one space to be cooled to another space or source designed to receive the rejected heat and may include commercial, institutional or residential refrigeration systems. Further, it is readily apparent that variations of the refrigeration system and its components and elements may be provided in a wide variety of types, shapes, sizes and performance characteristics, or provided in locations external or partially external to the refrigeration system. For example, components of a cooling system may be provided as rack-mounted system, or as a custom-installed hard-piped system, or may be provided as a modular unit or package. Accordingly, all such modifications are intended to be within the scope of the inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. A refrigeration system, comprising:

a first portion having a primary loop and a secondary loop operably coupled by a first chiller, the primary loop configured to circulate a refrigerant through the first chiller to provide cooling to a coolant in the secondary loop, the secondary loop having a supply portion and a return portion, the supply portion configured to circulate the coolant to one or more temperature-controlled storage devices operating at a first temperature; and a second portion having a primary loop and at least one secondary loop operably coupled by at least one second chiller, the primary loop configured to circulate a refrigerant through the second chiller to provide cooling to coolant in the secondary loop, the secondary loop having a supply portion and a return portion, the supply portion configured to circulate the coolant to one or more temperature-controlled storage devices operating at a second temperature;

wherein the return portion of the secondary loop of the first portion and the return portion of the secondary loop of the second portion share a common return header, wherein the second chiller pre-cools the coolant in the common return header to the second temperature and delivers the coolant at the second temperature to the supply portion of the secondary loop of the second portion, wherein the first chiller further cools the pre-cooled coolant from the second temperature to the first temperature and delivers the coolant at the first temperature to the supply portion of the secondary loop of the first portion.

2. The refrigeration system of claim 1, wherein the first temperature is less than the second temperature.

3. The refrigeration system of claim 2, wherein the coolant in the return portion of the secondary loop of the first portion pre-cools the coolant in the return portion of the secondary loop of the second portion.

4. The refrigeration system of claim 3, wherein the return portion of the secondary loop of the first portion diverges from the return portion of the secondary loop of the second portion after the second chiller.

5. The refrigeration system of claim 4, wherein the second chiller pre-cools the coolant in the return portion of the secondary loop of the first portion.

6. The refrigeration system of claim 5, wherein the return header further comprises a pump.

7. The refrigeration system of claim 2, wherein the second chiller comprises a plurality of second chillers, each of the second chillers operably coupled to a secondary loop, and each of the secondary loops operably coupled to a group of temperature-controlled display devices.

8. The refrigeration system of claim 7, wherein each of the groups of temperature-controlled display devices are configured to operate at a different temperature.

9. A refrigeration system, comprising:

a first portion having a first primary loop and a secondary loop operably coupled by a first chiller, the first primary loop configured to circulate a refrigerant through the first chiller to provide cooling to a coolant in the secondary loop, the secondary loop having a supply portion and a return portion, the supply portion configured to circulate the coolant to one or more temperature-controlled storage devices operating at a first temperature; and a second portion including at least one modular unit containing a second primary loop and a second chiller, the second portion further including at least one secondary loop operably coupled to the second chiller, the second primary loop configured to circulate a refrigerant through the second chiller to provide cooling to coolant in the secondary loop, the secondary loop having a supply portion and a return portion, the supply portion configured to circulate the coolant to one or more temperature-controlled storage devices operating at a second temperature;

wherein the return portion of the secondary loop of the first portion and the return portion of the secondary loop of the second portion share a common return header, wherein the second chiller pre-cools the coolant in the common return header to the second temperature and delivers the coolant at the second temperature to the supply portion of the secondary loop of the second portion, wherein the first chiller further cools the pre-cooled coolant from the second temperature to the first temperature and delivers the coolant at the first temperature to the supply portion of the secondary loop of the first portion.

10. The refrigeration system of claim 9, wherein the first temperature is less than the second temperature.

11. The refrigeration system of claim 10, wherein the at least one modular unit comprises a plurality of modular units, each having a second chiller operably coupled to a secondary loop, and each secondary loop configured to provide coolant to a group of temperature controlled storage devices.

12. The refrigeration system of claim 11, wherein each of the secondary loops share a common supply header and the common return header.

13. The refrigeration system of claim 12, wherein the return portion of the secondary loop of the first portion diverges from the return portion of the secondary loops of the second portion after at least one of the second chillers.

* * * * *